US007036164B2

(12) United States Patent
Dickerson

(10) Patent No.: US 7,036,164 B2
(45) Date of Patent: May 2, 2006

(54) AUTOMATIC BED MAKING APPARATUS

(76) Inventor: Stephen Lang Dickerson, 555 Tanacrest Dr., Atlanta, GA (US) 30328

( * ) Notice: Subject to any disclaimer, the term of this patent is extended or adjusted under 35 U.S.C. 154(b) by 98 days.

(21) Appl. No.: 10/794,719

(22) Filed: Mar. 5, 2004

(65) Prior Publication Data

US 2004/0211006 A1 Oct. 28, 2004

Related U.S. Application Data

(60) Provisional application No. 60/451,993, filed on Mar. 5, 2003.

(51) Int. Cl.
*A47C 21/00* (2006.01)

(52) U.S. Cl. ..... 5/488; 5/658; 5/905

(58) Field of Classification Search ..... 5/488, 5/658, 504.1, 505.1, 905
See application file for complete search history.

(56) References Cited

U.S. PATENT DOCUMENTS 3,581,321 A * 6/1971 Geary ..... 5/488
3,855,655 A * 12/1974 Propst ..... 5/488
3,895,404 A * 7/1975 Wilson ..... 5/482
3,946,450 A * 3/1976 Staggs ..... 5/488
4,042,985 A * 8/1977 Raczkowski ..... 5/488
4,305,167 A * 12/1981 Bargados ..... 5/488
4,441,222 A * 4/1984 Tascarella ..... 5/488
5,033,139 A * 7/1991 Renfro ..... 5/658
5,146,340 A * 9/1992 Dickerson et al. ..... 348/311
5,839,134 A * 11/1998 Matsuura et al. ..... 5/504.1
5,926,874 A * 7/1999 Browder ..... 5/488
2002/0170114 A1 * 11/2002 Wolcott ..... 5/488

* cited by examiner

*Primary Examiner*—Thomas B. Will
*Assistant Examiner*—Tara L. Mayo
(74) *Attorney, Agent, or Firm*—Thomas, Kayden, Horstemeyer & Risley

(57) ABSTRACT

A bed making apparatus can lift, push, and pull the bedding layer by layer so as to manipulate bedding originally disorganized to a made up state. The apparatus includes a vision device that evaluates and detects the current state of the bedding sensors and a computing device that determines the process of the making the bed. Typically, a robotic arm or roving device traverses the surface of the bed and can be attached to the headboard of the bed.

25 Claims, 4 Drawing Sheets

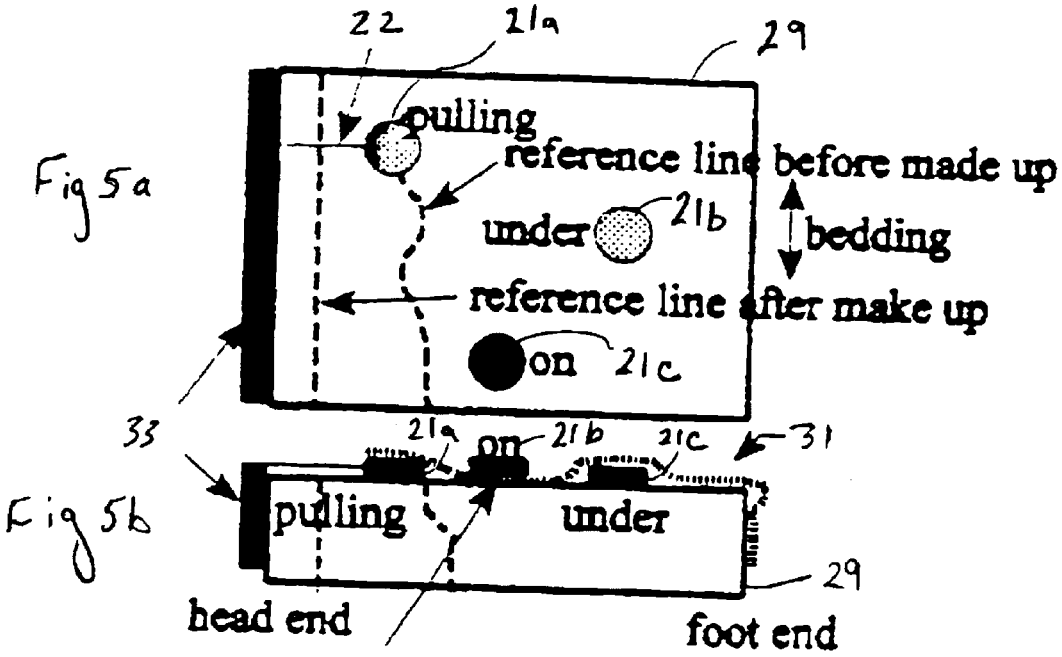
Fig 5a
Fig 5b
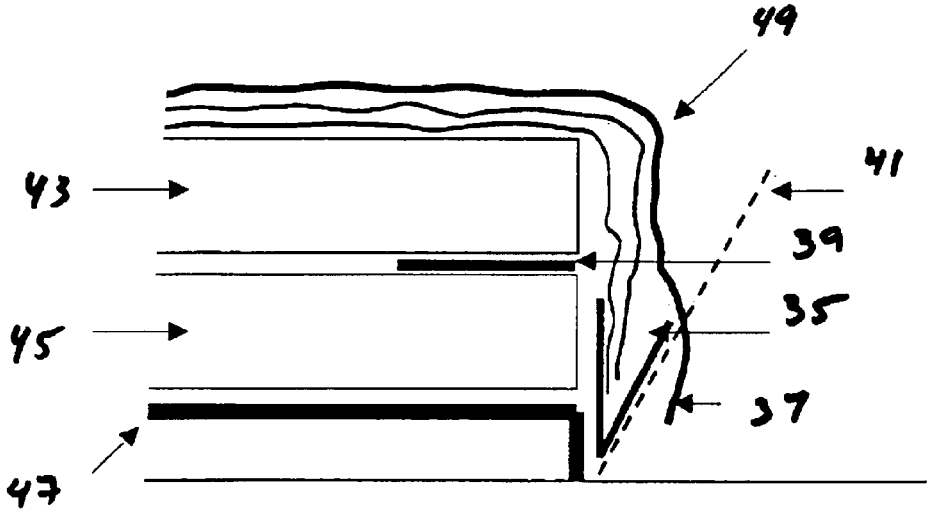
Fig. 6

AUTOMATIC BED MAKING APPARATUS

CROSS REFERENCE TO RELATED APPLICATION

This application claims priority to copending U.S. provisional application entitled, "AUTOMATIC BED MAKING APPARATUS," having Ser. No. 60/451,993, filed Mar. 5, 2003, which is entirely incorporated herein by reference.

FIELD OF THE DISCLOSURE

This invention relates generally to an apparatus for stacking flexible sheets of material and, more particularly, to an automatic bed making apparatus.

BACKGROUND

Devices for making beds have been in existence for many years. In most cases, devices require specialized bed linen and expensive power driven equipment in order to achieve fully automatic operation. As a consequence, it has not been feasble to make such apparatus for domestic use, even though it would be capable of making the bed where, for example, the bed was in a tight corner of a room where one side and/or one end only were readily accessible. Further, unless there were large numbers of beds to be made, as in a hotel, for example, making such equipment portable for transfer from room to room would not be economically feasble. It is, of course, possible to mount such a device permanently each bed. However, such a mounting would require special fittings which would, again, introduce to question of economic feasibility.

From the above, it can be appreciated that it would be desirable to have an apparatus that can be attached to a bed without undue expense, or can readily be made portable for movement from bed to bed. Further, such an apparatus would not require any modification of the bed for accommodating the apparatus in order to achieve fully automated operation.

SUMMARY OF THE DISCLOSURE

Disclosed are apparatuses representing a plurality of embodiments for making a bed. In one embodiment, a bed making apparatus includes a vision device for scanning the bed that produces a signal indicative of the state thereof. The apparatus further includes a computing device and a movable bedding manipulator apparatus. The computing device receives the signal and generates one or more instruction signals. The movable bedding manipulator apparatus receives the instruction signals and alters the state of the bed to produce a made bed. The bedding manipulator can extend over the bed when in operation and can move in elevation and horizontally.

In one embodiment, the bedding manipulator is a robotic arm and an end-effecter (e.g. gripper) that is moveable back and forth along the robotic arm. The end-effecter can lift, push, and pull the bedding layer by layer under the supervision of the vision device. In another embodiment, the bedding manipulator is a roving or crawler device that is placed on the bed for moving the sheets by pushing and pulling, and the computing device controls the movement and operation of the crawler under monitoring by the visio device.

In one embodiment, a method for making a bed comprises scanning the bed to obtain image data, determining a location of one or more layers based on the image data, and altering the state of the bed based on the determined location of the layers and the image data.

BRIEF DESCRIPTION OF THE DRAWINGS

The disclosed apparatuses can be better understood with reference to the following drawings. The components in the drawings are not necessarily to scale.

FIG. 5*a* is a bottom view of roving devices shown in FIG. 3 in several positions on the bed.

FIG. 5*b* is a side view of roving devices that coincide with FIG. 4*a*.

FIG. 6 is diagrammatic side elevation view of an embodiment of a bed making apparatus using a bedding holder.

DETAILED DESCRIPTION

Disclosed herein are bed making apparatuses to allow substantial automatic making of beds. The bed making apparatus can lift, push, and pull the bedding layer by layer so as to manipulate bedding originally disorganized into a made bed. Assuming that the bed is originally unmade but has all bedding and pillows in the top of the bed, the bed making apparatus lifts all pillows and shams to a side of the bed and lift all layers above he fitted sheet to the foot of the bed. The fitted sheet is smoothed out with brush motions toward the corners and edges. The first layer, generally a top sheet, is acquired and moved to the to of the bed through a process of lifts, pushes, and pulls. This is also done for each additional layers (e.g. blanket and comforter). The top layer (and additional layers) is smoothed with brush motions toward the corners and edges. The pillows are placed on the bed, typically near the headboard of the bed. The sham is added if it is used. Exemplary apparatuses are discussed with reference to the figures. Although these apparatuses are described in detail, they are provide for purposes of illustration only and various modifications are feasible.

Robotic Arm and End-effecter

Figure 1:
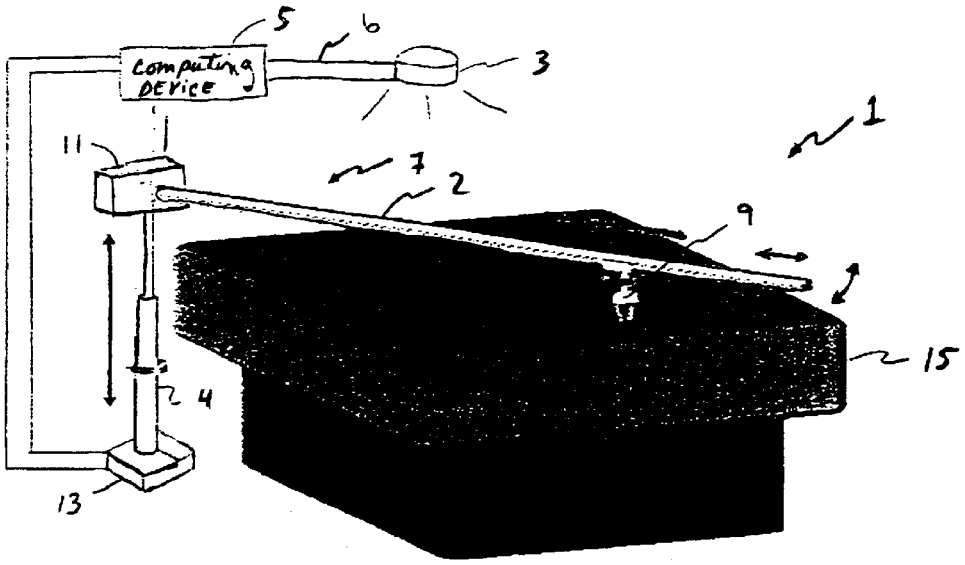
FIG. 1 is a schematic view of an embodiment of a bed making apparatus.

Referring now in more detail to the figures in which like reference numerals identify corresponding parts, FIG. 1 is a schematic view of an exemplary bed making apparatus 1 that alters the state of the bed. The apparatus 1 includes a vision device 3, a computing device 5, and a movable bedding manipulator apparatus 7. The vision device 3 can include one or more cameras that are mounted above the bed 15 for viewing the entire bed 15. The vision device 3 can include a color array detector and/or gray scale detector to detect two properties of the state of the bedding: (1) the location of each layer and (2) the amount and orientation of wrinkles. The camera can be self-powered from batteries or direct connection to the power of the building that is electrical coupled to the computing device 5. The vision device 3 scans the bed 15 and produces a signal indicative of the state of the bed 15. The vision device 3 sends the signal to the computing device 5. The vision device 3 is connected to the computing device 5 via line 6. Alternatively, the vision device 3 can communicate tetherlessly with the computing device 5. The vision device 3 can be mounted to the ceiling of the room above the bed 15 or to the bedding manipulator 7 that can move the vision device 3 therewith about the bed 15 to view the state of the bed 15.

The algorithms to locate the distinct layers based on the image data from vision device are 3 implemented in the computing device 5. Such algorithms take advantage of shadows, e.g., to find edges and wrinkles as well as color, gray scale, and textural differences to find both edges and distinguish between layers of fabric. It should be noted that the computing device 5 can be integrated with the vision device to form one device as well as being two separate devices. It should also be noted that the computing device 5 can be integrated with bedding manipulator apparatus 7 to form one device.

The computing device 5 is coupled to the movable bedding manipulator 7. The computing device 5 receives the signal indicative of the state of the bed 15 from the vision device 3 and generates instruction signals for the movable bedding manipulator 7. The movable bedding manipulator apparatus 7 receives the instruction signals from the computing device 5 and alters the state of the bed 15 to produce a made bed. The computing device 5 determines the status of the bedding based on processing of color and/or gray scale information sensed from the vision device 3.

The movable bedding manipulator apparatus 7 includes a first motor 13, a second motor 11, a extendable leg 4, a robotic arm 2, and an end-effecter 9 (e.g. a gripper). The first motor 13 is connected to the extendable leg 4 and can extend the leg 4 for azimuth and elevation of the manipulator apparatus 7. The extendable leg 4 is connected to a second motor 11, which is connected to the robotic arm 2. The robotic arm 2 can be built into or mounted adjacent to the headboard or mounted directly to the frame of the bed 15. When not in use, the robotic arm 2 is recessed into the headboard or is above the headboard. The robotic arm 2 extends from the head to the foot of the bed and can move about the bed 15. The robotic arm 2 is coupled to the end-effecter 9 where the end-effecter 9 manipulates one or more layers of the bedding and moves the layer(s) in accordance with the instruction signals of the computing device 5. For example, the end-effecter (e.g., a gripper) can lift and hold one or more layers of bedding.

It should be noted that any classical robotic construction is possible. Only the preferred embodiment has been described. Another robotic construction for the bed making apparatus is a roving device as further described in FIGS. 3–4.

Figure 2:
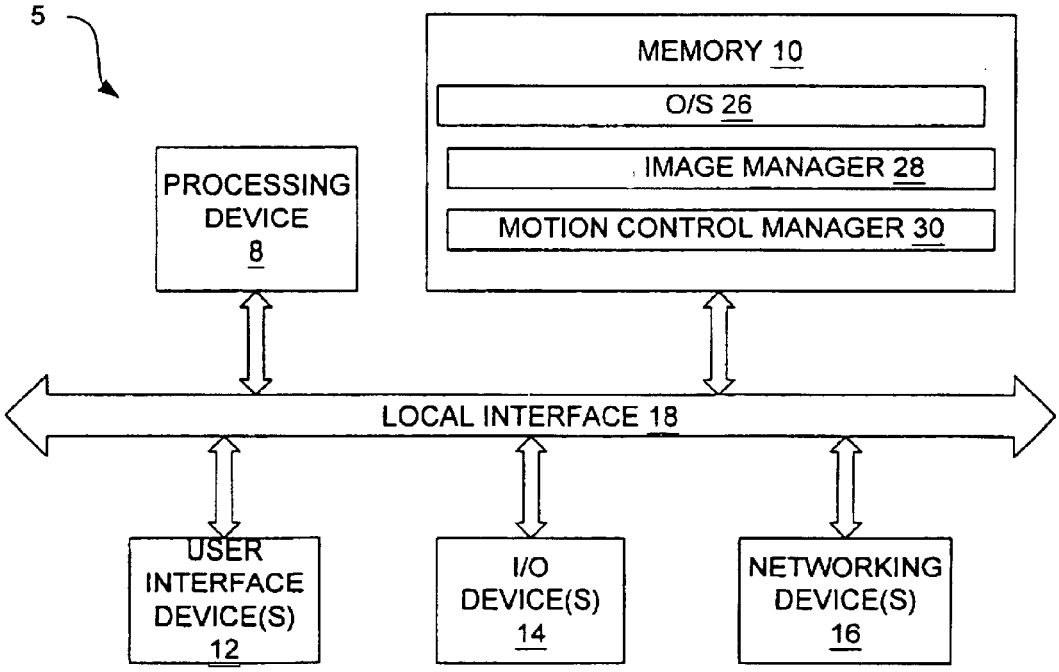
FIG. 2 is a block diagram of an embodiment of a computing device shown in FIG. 1.

FIG. 2 is a block diagram of an embodiment of a computing device shown in FIG. 1. As indicated in FIG. 2, the computing device 5 comprises a processing device 8, memory 10, one or more user interface devices 12, one or more I/O devices 14, and one or more networking devices 16, each of which is connected to a local interface 18. The processing device 8 can include any custom made or commercially available processor, a central processing unit (CPU) or an auxiliary processor among several processors associated with the computing device 5, a semiconductor based microprocessor (in the form of a microchip), or a macroprocessor. The memory 10 can include any one or a combination of volatile memory elements (e.g., random access memory (RAM, such as DRAM, SRAM, etc.)) and nonvolatile memory elements (e.g., ROM, hard drive, tape, CDROM, etc.).

The one or more user interface devices 12 comprise those components with which the operator can interact with the computing device 5. Where the computing device 5 comprises a server computer or similar device, these components can comprise those used in conjunction with a PC such as a keyboard and mouse.

The one or more I/O devices 14 comprise components used to facilitate connection of the computing device to other devices and therefore, for instance, comprise one or more serial, parallel, small system interface (SCSI), universal serial bus (USB), or IEEE 1394 (e.g., Firewire™) connection elements. The vision device 3 and the manipulator apparatus 7 can be coupled to the computing device 5 via the I/O device 14. The networking devices 16 comprise the various components used to transmit and/or receive data over the network 16, where provided. By way of example, the networking devices 16 include a device that can communicate both inputs and outputs, for instance, a modulator/demodulator (e.g., modem), a radio frequency (RF) or infrared (IR) transceiver, a telephonic interface, a bridge, a router, as well as a network card, etc.

The memory 10 normally comprises various programs (in software and/or firmware) including an operating system (O/S) 26, a camera image manager 28, and a motion control manager 30. The O/S 26 controls the execution of programs, including the motion control manager 30, and provides scheduling, input-output control, file and data management, memory management, and communication control and related services. The image manager 28 facilitates the process for detecting the location of each layer and the amount and orientation of wrinkles. Typically, the process involves receiving image data from the vision device 3 that includes information about, but not limited to, the texture, color, gray scale, shadow, and intensity. The motion control manager 30 further facilitates the process for making the bed based on the image data from the vision device 3. Operation of the image manager 28 is described in relation to FIG. 7 and the motion control manager 30 is described in relation to FIG. 8.

Procedure for Making a Bed with a Robotic Arm and End-effecter

The bedding manipulator apparatus 7 can start lifting all pillows to the side of the bed 15 using the end-effecter 9 and robotic arm 2 to grip, lift, and move the pillows. All the layers are lifted above the fitted sheet to near the foot of the bed 15. The layers are piled in reverse order of making the bed 15. For example, the comforter is closest to the foot of the bed, the blanket next, top sheet closest to the head so that the layers are visible to the vision device. The fitted sheet is smoothed with brush motions to the comers and edges. The top sheet is now moved with several controlled motions to the made-up position with the top edge near the headboard of the bed 15. The end-effecter 9 grips near the edges of the sheet so as to maximize the probability that the comers will be visible. The sheet is manipulated until the comers and edges of the sheet are visible and then the comers and edges are pulled up and centered on the bed. Each corner and edge is pulled to the extent possible to the correct final position. If this can't be done approximately, repeat lifting the top sheet on top of the bed, pulling the corners and edges of the top sheet up and to its final made-up position so as to cover most of the bed area. The sheet is then smoothed out with brush motions to the comers and edges. These motions may require analysis of wrinkles in the layer that is determined by the vision device. The procedure is repeated for the blanket, comforter, and sham. The pillows are lifted and place in position.

Roving Device

Figure 3:
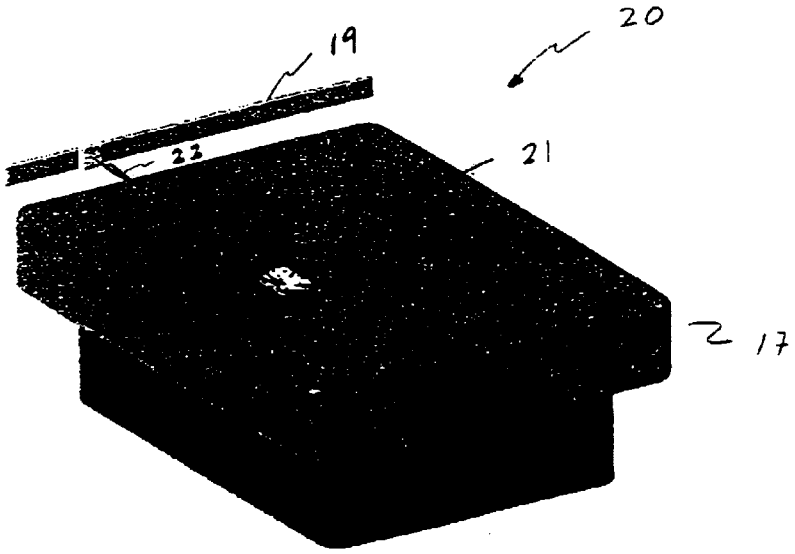
FIG. 3 is a perspective view of another embodiment of a bed making apparatus utilizing roving devices.

FIG. 3 is a perspective view of another embodiment of a bed making apparatus using a roving device that functionally replaces the robotic manipulator as shown in FIG. 1. The bed making apparatus 20 includes a vision device (not shown), computing device (not shown), and the roving device 21. The roving device 21 is coupled to a headboard-mounted apparatus 19 via a power or tensile cable 22. The roving device 3 moves on the surface of the bed 17 and/or bedding. In an alternative embodiment, the roving device can be self-powered via batteries and can communicate tetherlessly with the computing device without the power or tensile cable 22. The roving device 21 can move under the layer(s) of the bedding.

The headboard-mounting apparatus 19 can be mounted between the bed mattress and the headboard (if used) or is part of the headboard itself. The cable 22 together with the headboard-mounting apparatus 19 can be used to locate the roving device 21 relative to the bed and to provide traction (through cable tension), power, and communications. The cable 22 can be used both for enabling movement toward the head of the bed, to supply electrical power, and to communicate with the computing device and vision device. The algorithms to locate the distinct features of the roving device 21 by the use of cameras are implemented in the vision device. Such algorithms take advantage of shadows, e.g., to find edges of the roving device 21 as well as color, gray scale, and textural differences to find the roving device 21.

The headboard-mounting apparatus can include a traveling cable dispenser that keeps the cable 22 under tension and can move back and forth so as to keep the cable 22 running perpendicular to the headboard of the bed. The amount of dispensed cable 22 and the position of the dispenser can be used to sense the roving device 21 position on the bed 17. The position of the roving device 21 on the bed can further be determined by obtaining the angle of the cable 22 using the vision device (not shown). In other words, the tension, angle, length, and direction of the cable 22 to the roving device 21 can be used to detect the pulling forces and location of the roving device 21. In an alternative embodiment, the position of the roving device 21 can be determined using the vision device, which the vision device can locate the roving device 21 on the bed.

Figure 4:
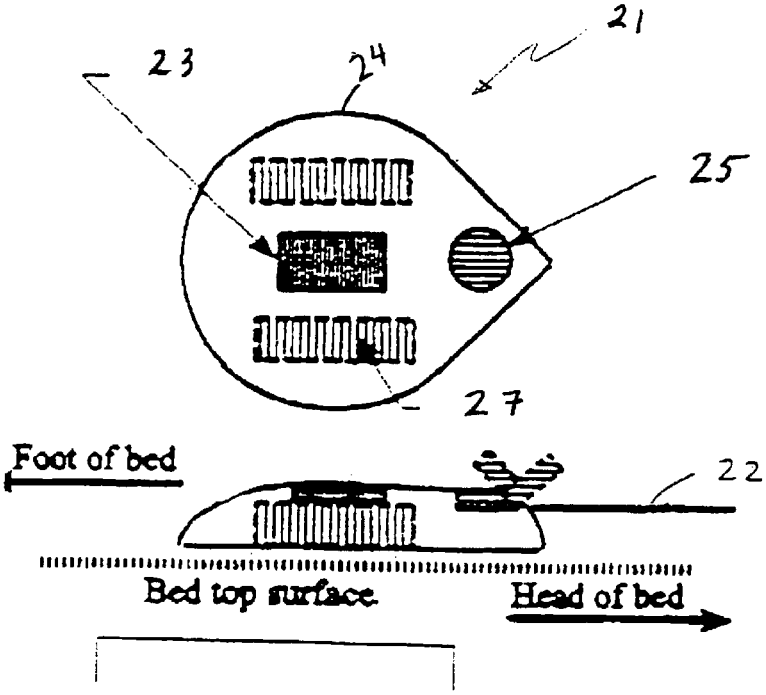
FIG. 4 is a schematic view of an embodiment of a roving device shown in FIG. 3.

FIG. 4 is a schematic view of an embodiment of a roving device shown in FIG. 3. The roving device 21 can grip, release, push, pull and feed layers of bedding. It moves under, over, and adjacent to layers of bedding to alter the state of the bed 17 to produce a made bed. The roving device 21 includes housing 24, wheels or crawler 27, a microprocessor 23 and a grip member 25. The housing 24 is compact and has a smooth turtle-like top. The housing 24 houses the crawler 27, the microprocessor 23 and the grip member 25. The roving device 21 is electrically powered such that the crawler 27 located at the bottom of the housing 24 can move between layers of the bedding as well as on top of the bedding. The roving device 2 can be powered from a battery or a power cable, such as cable 22.

The microprocessor 23 receives instruction signals from the computing device (not shown) and operates the roving device 21 in accordance to the instruction signals. The microprocessor 23 can instruct the crawler 27 to move the roving device 234 and actuate the grip member 25 in accordance to the instruction signals from the computing device. The microprocessor 23 can be stored in the headboard-mounting apparatus (not shown) or in the housing 24 of the roving device. The microprocessor 23 can sense currents and voltages of the crawler 27 to control the force and speed level of the roving device 21.

In an alternative embodiment, the microprocessor 23 can function as both the controller of the roving device and computing device 5. In other words, the bed making apparatus 20 comprises the vision device (not shown) and the roving device 21 without the computing device (not shown). The microprocessor 23 can receive image data from the vision device and instruct the roving device to alter the state of the bed based on the received image data.

The bed making apparatus 20 can be moved from bed to bed in the case that multiple beds are to be made. For example the headboard-mounting apparatus (as shown in FIG. 3), the roving device 21, the computing device, and the vision device can be moved to another bed to alter the state of the bed to produce a made bed. In an alternative embodiment, the other bed may have a vision device and a computing device, but not the roving device and the headboard-mounting apparatus. In this regard, the roving device and the headboard-mounting apparatus is portable to the other bed and can operate with the vision device and the computing device already mounted on the other bed.

In the case of the battery powered roving device, the roving device can be moved to the other bed and communicate tetherlessly with the vision device and the computing device. An audible or electronic signal can be incorporated to alert an operator that the bed is made or that the apparatus 20 needs assistance. In one embodiment, the roving device can be built into the headboard and automatically extend and retract into the headboard. It should be noted that more than one roving device can be used to speed up the bed making process.

It should be noted that the roving device 21 can be of various constructions and shapes. For example, it could have multiple grip members, or could be designed to include the full width of the bed rather than move across the bed.

FIG. 5*a* is a bottom view of roving devices shown in FIG. 3 in several positions on a bed. FIG. 5*b* is a side view of roving devices on the bed as shown in FIG. 4. FIG. 5*a–b* show three roving devices 21*a–c*, but preferably only one is used in practice. Referring now to FIG. 5*a–b*, roving device 21*a* is shown in the PULLING position where a grip member of the roving device 21*a* can either grip the bedding or not. If nothing is gripped, the roving device 21*a* is free to move under bedding. Roving device 21*b* is shown in the UNDER position where the roving device 21*b* is in the position to push bedding toward the foot of the bed or begin to grip bedding. Roving device 21*c* is shown in the ON position and in the position to push the bedding toward the headboard 33 of the bed. Roving device 21*c* can be used both on top and beneath layers that had undesired folds toward the rear and push the layer so as to unfold. In addition, the ON position of the roving device 21 can be used to push bedding sideways toward the edge of the bed or to track the edge of bedding. In any of the three (3) positions, the roving device 21 can be used to push bedding sideways toward the edge of the bed, which is necessary both for centering of bedding layers and for wrinkle removal.

Procedure for Making a Bed with a Roving Device

The operator first manually places the bedding on top of the bed. That is, the bedding is not significantly on the floor and is accessible to the roving device 21. It is preferred that each layer is partially visible for the vision device to determine the state of the bed and each layers are ordered with the bottom layer closest to the head of the bed. The operator starts the bed making apparatus by pushing a button or opening the headboard-mounting apparatus. The headboard-mounting apparatus opens and the cable dispenser protrudes from the head-mounting apparatus. Alternatively, the cable dispenser may always be accessible. The operator sets the roving device on top of the bed near the cable dispenser and plugs the roving device to the cable dispenser.

The roving device moves down the bed and goes under the first layer encountered. When fabric is sensed over the crawler and into the grip member, the grip member grips the fabric and the roving device moves back toward the head of the bed dragging the layer. When sufficient load is sensed the roving device moves sideways to eliminate sideways force. This is to cause the fabric to be aligned with the bed so that the layer is centered. The roving device goes under the same layer at several different locations across the bed, grips the fabric, and moves the fabric sideways until the layer is brought to the top of the bed.

If the layer is not brought to the final top position, then the bed making apparatus assumes that the layer is folded under and/or over, which is detected by the vision device. The roving device then moves under and over the layer in several positions and rakes the layer forward with protrusions on top or bottom of the roving device. Once the roving device rakes the layer, the roving device repeats the steps of going under the layer again, gripping the fabric, moving the fabric sideways, and raking the layer until the layer is at the proper position. The roving device then goes down each edge of the bed, brushes outward and slightly upward the fabric so as to cause the layer to fall over the edge.

The roving device moves up one layer and repeats the steps described above. In order to move up, the roving device can be pulled toward the headboard and tilt straight up the headboard and set itself down on top of next layer. At any point the roving device could "give up" and realize that the bed could not be made. The roving device can emit a tone that indicates distress. However, if the roving device successfully complete making the bed, the roving device can emit a different more pleasant tone. When the bed making apparatus is complete making the bed, the operator can remove the roving device off the bed and place the pillow. If the bed is not made, the operator can adjust some of the layers and restart the bed making apparatus with the roving device placed on top of the last completed layer.

FIG. 6 is perspective view of an embodiment of a bed making apparatus using a bedding holder. The bedding holder 35 is used to tuck in the layer after the layer is pulled up to the head of the bed. The bedding holder 35 or similar device is used to hold the layers on remake. However, the bed maker could pull the spread back so as to have the layer drape properly over the base even if the layer were not permanently fastened in position. The bedding holder 35 is used to secure the layers of bedding 49 at the foot of the bed. The holder 35 can be attached to the bed frame 47 at the foot of the bed. The bedding holder 35 is constructed as a hinged device with sufficient closing force to hold the bedding 49. The hinge is preferably made such as to snap open and closed.

In an alternative embodiment, a bedding holder 39 can be inserted between the mattress 43 and the box spring 45. The bedding holder is a bar 39 incorporating high friction surfaces that is placed between the mattress and box spring. In the latter case the bedding holder 35 must be fabricated to be thin and with external surfaces of high friction. In either case, the bedding holder 35, 39 is fabricated to provide a secure clamping of the bedding within the holder. Optionally, the top layer of bedding, the bed spread 37 may not be clamped for purposes of better appearance of the bed. Alternately, a footboard 41 can be attached to the bedding holder 35 so that the holder 35 and footboard 41 are one assembly.

The holder 35, 39 is only applied when the bedding is changed, e.g., when the top and bottom sheet are replaced with clean sheets. The bed making machine itself would not automatically insert bedding in the holder 35, 39. However, in one embodiment the holder 35, 39 can be motorized in opening and closing.

Operation of an Image Manager

Figure 7:
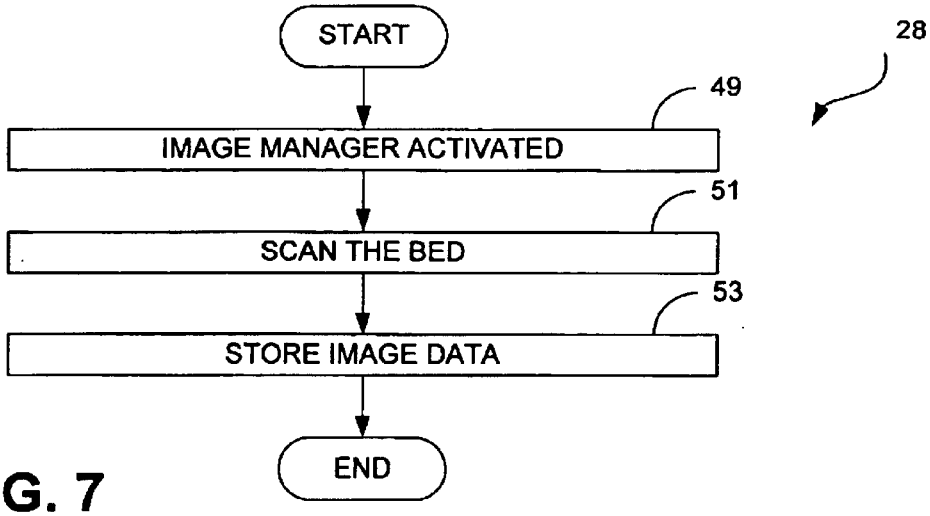
FIG. 7 is a flow diagram that illustrates an embodiment of operation of an image manager of the computing device shown in FIG. 2.

FIG. 7 is a flow diagram that illustrates an embodiment of operation of an image manager of the computing device that facilitates the process of making bed. As indicated in block 49, the image manager 28 is activated when the operator powers the bed making apparatus. The image manager 28 then instructs a vision device to scan the bed to obtain digital image of the bed, as indicated in block 51. The digital image contains information of, but not limited to, shadows, color, gray scale, and textural of each layer of the bedding. The digital image is stored in memory of the computing device, as indicated in block 53.

Operation of a Motion Control Manager

Figure 8:
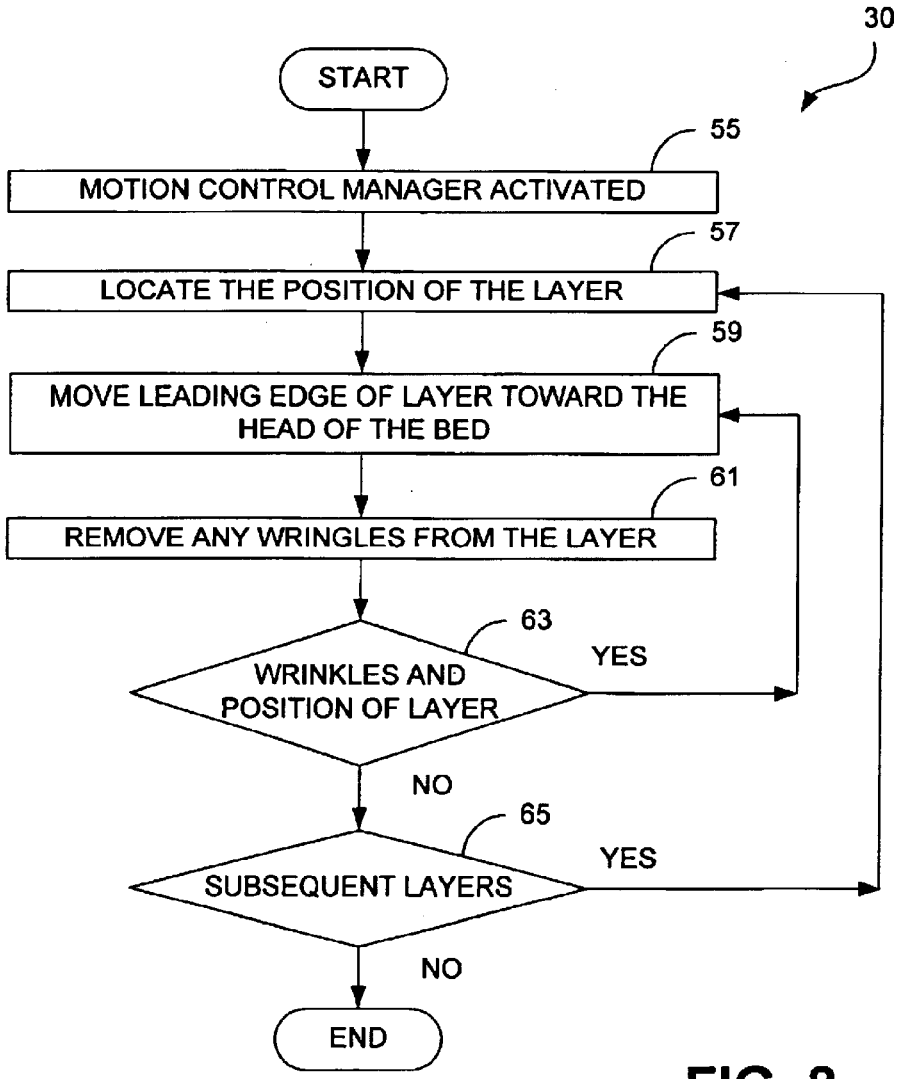
FIG. 8 is a flow diagram that illustrates an embodiment of operation of a motion control manager of the computing device shown in FIG. 2.

FIG. 8 is a flow diagram that illustrates an embodiment of operation of a motion control manager of the computing device that facilitates the process of making bed. In general, the motion control manager 30 receives image data of the state of the bed from a vision device. The manager 30 determines a location of one or more layers based on the image data and instructs the bedding manipulator apparatus to alter the state of the bed based on the determined location of the layers and the image data.

Now referring to FIG. 8, as indicated in block 55, the motion control manager is activated when the operator powers the bed making apparatus. The motion control manager 30 locates the position of each layer based on an image data of the state of the bed scanned from a vision device, as indicated in block 57. Once the position of each layer is located, the motion control manager 30 instructs the movable bedding manipulator apparatus to move the leading edge of a first layer toward the head of the bed, as indicated in block 59. The portions of the leading edge that are closest to the foot of the bed are generally favored to be moved. As the leading edge is being moved, the position of the layer is scanned by the vision device and the motion control manager 30 determines the whether to continue to move the leading edge toward the head of the bed.

When the leading edge cannot be further advanced, the motion control manager 30 assumes that the layer is folded back on top of itself and instructs the bedding manipulator apparatus to lift the folded back portion toward the head of the bed. If this fails to bring the layer to the proper location relative to the head of the bed, the motion control manager 30 assumes that the layer is folded under itself and instructs the bedding manipulator apparatus to reveal or extract the folded-under material and move it to the head of the bed.

After the layer has been pulled as far as possible toward the head of the bed, the bed is scanned for wrinkles and straightness of the layer from foot to head. The motion control manager 30 instructs the bedding manipulator apparatus to remove any wrinkles and straighten the layer from foot to head based on a scanned image data, as indicated in block 61. In one embodiment, the bedding manipulator apparatus can straighten the layer while maintaining tension in the layer. In another embodiment, the bedding manipulator can move the layer of the bedding in a way that allows no forces perpendicular to the foot to head direction and thus the layer becomes aligned.

The motion control manager 30 then determines whether the layer of bedding contains any wrinkles and whether the layer is properly positioned based on a scanned image data, as indicated in block 63. If there are wrinkles and the layer is not properly positioned, the layer is manipulated as explained above in blocks 59 and 61 are repeated. If the layer is properly set on the bed, the motion control manager 30 determines whether there are subsequent layers, as indicated in block 65, based on a received image data from the vision device. If there are subsequent layers, the next layer is located and manipulated as explained above in blocks 57, 59, and 61.

It should be emphasized that the above-described embodiments of the present invention are possible examples of implementations, and are set forth for a clear understanding of the principles of the invention. Many variations and modifications may be made to the above-described embodiment(s) of the invention. All such modifications and variations are intended to be included herein within the scope of this disclosure and protected by the following claims.

What is claimed is:

1. A bed making apparatus comprising:

a vision device for scanning the bed that produces a signal indicative o the state thereof;

a computing device for receiving the signal and generating one or more instruction signals; and a movable bedding manipulator apparatus for receiving said instruction signals and altering the state of the bed to produce a made bed.

2. The apparatus as defined in claim 1, where the vision device includes one or more cameras that are mounted above the bed for viewing the entire bed.

3. The apparatus as defined in claim 2, where the one or more cameras are mounted to the ceiling of the room.

4. The apparatus as defined in claim 3, where the one or more cameras are self-powered from batteries or direct connection to the power of the building and includes tetherless communications with the computing device.

5. The apparatus as defined in claim 2, where the one or more cameras are mounted on the bedding manipulator and can be moved therewith about the bed to view the state of the bed.

6. The apparatus as defined in claim 2, where the bedding manipulator is a roving device that moves on the surface of the bed and/or bedding.

7. The apparatus as defined in claim 6, where the roving device is coupled to a headboard mounted apparatus via one or more power or tensile cables.

8. The apparatus as defined in claim 6, where the roving device is self-powered from batteries and includes tetherless communications with the computing device.

9. The apparatus as defined in claim 6, where the roving device is adapted to move under one or more layers of bedding.

10. The apparatus as defined in claim 6, wherein the bedding manipulator comprises a robotic arm and an end-effecter to manipulate the bedding.

11. The apparatus as defined in claim 10, where the robotic arm is mounted on the headboard of the bed and can be stored in or above the headboard when not in use.

12. The apparatus as defined in claim 11, where the mounting of the robotic arm is mounted directly to the frame of the bed.

13. The apparatus as defined in claim 10, where the end-effect is a gripper that can lift and hold one or more layers of bedding.

14. The apparatus as defined in claim 1, where the vision device includes a color array detector.

15. The apparatus as defined in claim 1, where the computing device determines the status of the bedding based on processing of color and/or gray scale information.

16. The apparatus as defined in claim 1, where the computing device is a microcomputer having robotic motion command algorithms that are intended to make the bed layer by layer so as to successively properly position the layers from bottom to top layer.

17. The apparatus as defined in claim 16, where the microcomputer generates instruction signals to remove wrinkles.

18. The apparatus as defined in claim 1, where the bedding manipulator further places pillows on the bed.

19. The apparatus as defined in claim 1, further comprising a bedding holder that allows the bedding to be attached to the foot of the bed.

20. The apparatus as defined in claim 19, where the bedding holder is a bar incorporating friction surfaces that is placed between the mattress and box spring.

21. The apparatus as defined in claim 20, where the bar provides secure clamping of the bedding.

22. The apparatus as defined in claim 19, where the bedding holder is mounted to the frame of the bed near the foot of the bed.

23. The apparatus as defined in claim 22, where the bedding holder is mounted such that the footboard can also be mounted near the foot of the bed.

24. A method for making a bed comprising:

scanning the bed to obtain image data via a vision device that are indicative of the state of the bed;

determining a location of one or more layers via a computing device includes a commercially available processor based on the image data from the vision device; and altering the state of the bed via a movable bedding manipulator based on the determined location of the layers and the image data.

25. A motion control manager for making bed, the manager stored in a computer-readable medium, the manager comprising:

logic configured to receive an image data of the state of the bed from a vision device;

logic configured to determine a location of one or more layers based on the image data; and logic configured to alter the state of the bed using a movable bedding manipulator based on the determined location of the layers and the image data.

* * * * *